United States Patent [19]

Bilek

[11] 3,999,482

[45] Dec. 28, 1976

[54] HIGH EXPLOSIVE LAUNCHER SYSTEM

[75] Inventor: Andrew G. Bilek, Valparaiso, Fla.

[73] Assignee: The United States of America as represented by the Secretary of the Air Force, Washington, D.C.

[22] Filed: July 9, 1975

[21] Appl. No.: 594,427

[52] U.S. Cl. ..... 102/7.2; 102/6; 102/66; 102/90

[51] Int. Cl.[2] ..... F42B 25/00

[58] Field of Search ..... 102/6, 66, 65, 60, 87, 102/90, 34.4, 7.2, 37.6, 35.6; 89/1 F, 1 J, 8, 1.816

[56] References Cited

UNITED STATES PATENTS

| | | | |
|---|---|---|---|
| 1,539,027 | 5/1925 | Stott | 89/1 F X |
| 1,791,716 | 2/1931 | Davis et al. | 102/66 |
| 3,382,800 | 5/1968 | Biggs, Jr. | 102/90 X |
| 3,457,826 | 7/1969 | Stone | 89/8 X |
| 3,570,401 | 3/1971 | Euker | 102/66 |
| 3,596,602 | 8/1971 | Gey | 102/90 |
| 3,596,603 | 8/1971 | Grything | 102/90 |
| 3,636,874 | 1/1972 | Gey | 102/90 |
| 3,713,383 | 1/1973 | Crescenzo | 102/90 |
| 3,730,093 | 5/1971 | Cummings | 102/66 X |

*Primary Examiner*—Harold Tudor
*Attorney, Agent, or Firm*—Joseph E. Rusz; Arsen Tashjian

[57] ABSTRACT

A cloud detonation initiator on a fuel-air-explosive (FAE) weapon in the form of a high-explosive retrolauncher attached thereto wherein a plurality of gun tubes each deploy an explosive grenade rearwardly to compensate for the forward motion of the FAE weapon. The grenades are essentially stopped in space as the cloud forms around them. The retrolauncher includes a plurality of different size charges in operative communication with a single chamber so that the velocity of the grenades can be controlled within a predetermined range by selectively detonating the charges singly and in combination.

4 Claims, 2 Drawing Figures

HIGH EXPLOSIVE LAUNCHER SYSTEM

STATEMENT OF GOVERNMENT INTEREST

The invention described herein may be manufactured and used by or for the Government for governmental purposes without the payment of any royalty thereon.

BACKGROUND OF THE INVENTION

This invention relates to a fuel-air-explosive (FAE) weapon system and, more particularly, the invention is concerned with providing a high explosive launching system for deploying an explosive charge in the gas cloud of the FAE weapon by rearwardly launching a grenade which then remains relatively stationary in space while the gas cloud is formed and, after a suitable delay, the grenade explodes causing the cloud to detonate.

State of the art fuel-air-explosive (FAE) weapons require two distinct events for a successful detonation. The first event is dispersal of a fuel into either a large gas cloud or a two phase cloud of very small fuel droplets and air. A gas cloud is formed from compressed gas, while a two phase cloud is formed from a liquid, such as propylene oxide. Either type of fuel may be used, and in both cases, formation of the cloud relies upon a high-explosive central burster that not only ruptures the bomb case but also immparts a very high radial velocity to the fuel. The time required for cloud formation is a function of several factors: size of central burster, amount of fuel, type of fuel, configuration of central burster, and weapon configuration. Typical fuel dispersal times are 100 milliseconds for 325 pounds of propylene oxide, 800 milliseconds for 400 pounds of compressed gas, and 225 milliseconds for 1600 pounds of propylene oxide.

Once the cloud has been formed, a detontation is intitiated by introducing a minimum amount of energy into the cloud at nearly the instant it reaches the proper fuel-air ratio (close to stoichiometric). The generally adopted method has been to use a high explosive charge. The size of the charge depends on the fuel-air ratio of the cloud and on the proximity of the charge to the cloud. The detonation of the explosive charge is considered the second event in a fuel-air explosion, and the system that deploys that charge is termed the second event system, or the cloud detonator system.

A successful fuel-air-explosion requires a rather precise system to initiate detonation of the cloud. The high explosive charge must be placed directly in the cloud if a minimum size charge is used, since the amount of explosive required to initiate the cloud increases quickly as the distance from the cloud increases. The timing of the detonation of the initiating charge is also critical because the time during which the cloud is detonable is very short. For example, a cloud produced by the dispersion of 325 pounds of propylene oxide is detonable during an interval from about 90 to 200 milliseconds with an explosive charge of greater than 10 grams. A larger high explosive charge allows initiation of the cloud over a slightly wider time range, and would increase the probability of detonating the cloud if the cloud detonating charge was in a lean area of the cloud.

The most reliable type of cloud detonator system is the high explosive retrolauncher concept. This concept relies on one or more launchers that each launch an explosive grenade rearward to compensate for the forward motion of the FAE weapon. The grenades are essentially stopped in space as the cloud forms around them. A pyrotechnic delay is initiated when the launchers fire, so the grenades detonate after an appropriate delay time and initiate a fuel-air-explosion.

SUMMARY OF THE INVENTION

The present invention is concerned with providing a system for detonating a fuel-air-explosive weapon by rearwardly launching a plurality of grenades into the fuel-air cloud. The amount of propellant charge used to launch the grenades is varied as a function of the bomb speed with four explosive charges used as the propellant charges. All four charges are in operative communication with a single chamber and are selectively fired in the combination that produces the desired launch velocity.

Accordingly, it is an object of the present invention to provide a multi-barreled high explosive launcher system with no moving parts wherein a group of explosive charges of various sizes are selectively fired to produce grenade velocities matched to the terminal velocity of the FAE (fuel-air-explosive) bomb.

Another object of the invention is to provide a high explosive launcher system wherein the grenades are propelled in a wide velocity range within the very short launch time required for the detonation of the fuel-air mixture.

Still another object of the invention is to provide a gun system for the second event detonation of a gas cloud wherein a plurality of grenades are each fired at a uniform velocity from a corresponding plurality of gun tubes.

A further object of the invention is to provide a multi-barreled launcher system which includes a selection charge firing system wherein only programmed charges will fire with any remaining charges being decoupled to avoid sympathetic detonation thereby producing variable explosive speed control.

A still further object of the invention is to provide a high explosive launcher system for the second event detonation of a gas cloud wherein the positioning and angle of a plurality of gun tubes are adjustable to control the trajectory of the grenades for all sizes of fuel-air-explosive bombs.

Another still further object of the invention is to provide a launcher system that is very compact and, therefore, easily attachable to the rear of all sizes of FAE bombs. The compactness of the launcher unit permits installation within the bomb fin fairing and does not interfere with the bomb fins.

These and other objects, features, and advantages will become more apparent after considering the following detailed description taken in conjunction with the annexed drawings and appended claims.

DESCRIPTION OF A PREFERRED EMBODIMENT

Figure 1:
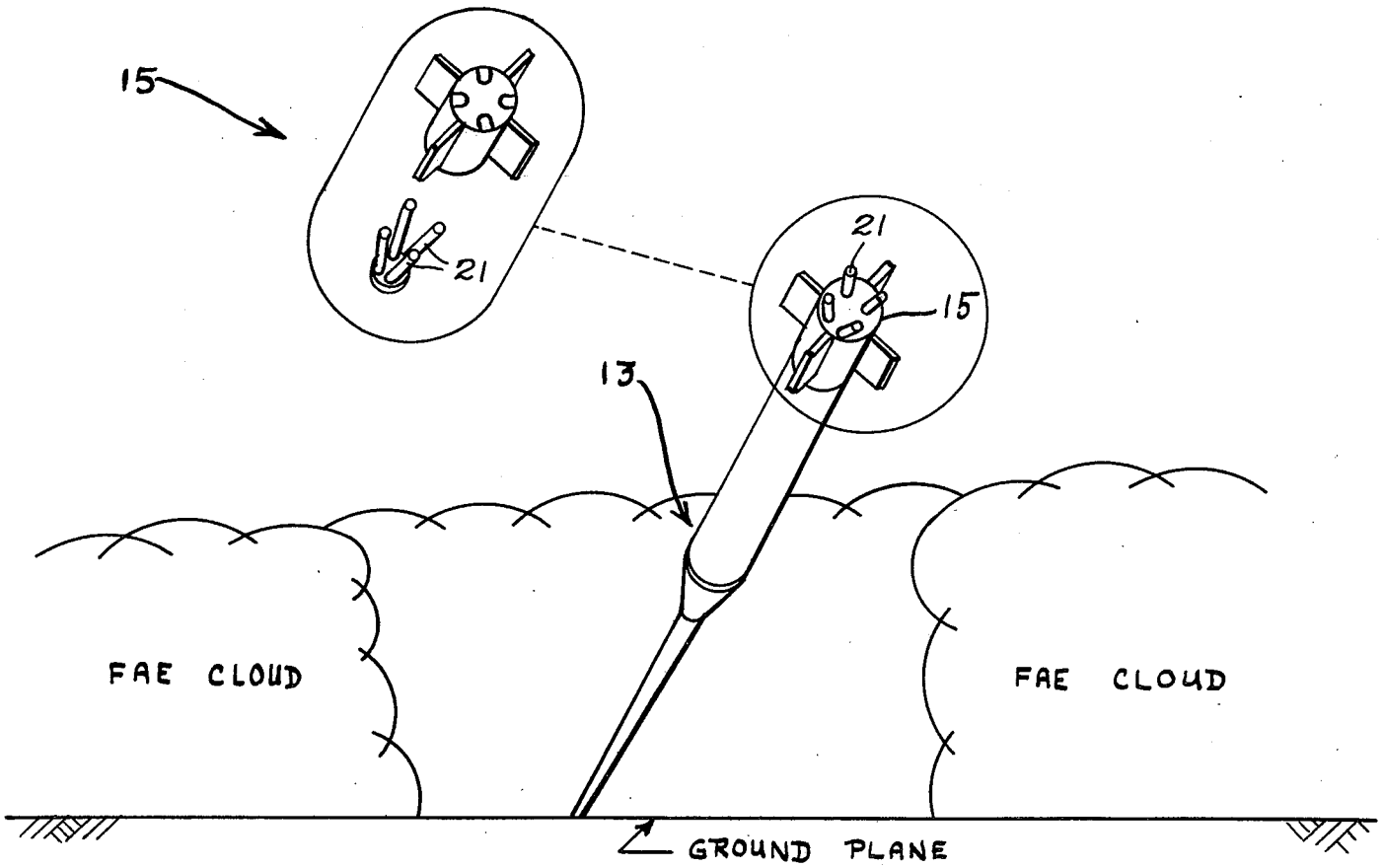
FIG. 1 is a general view illustrating the basic concept of a fuel-air-explosive (FAE) system showing the FAE cloud which forms after the fuel container bomb has burst and distributed and mixed the fuel with air in the area and includes an exploded view of the launcher.

Referring now to the drawings, FIG. 1 illustrates the fuel-air-explosive (FAE) device 13 which disperses fuel to form a large detonable FAE cloud. The cloud will generally have a central hole along the line of flight of the FAE bomb 13 while the cloud itself forms in a distorted torus shape which is further locally distorted by the ground plane. The relative size and final shape of the FAE cloud will depend upon many variables including the terminal aerodynamics of the FAE bomb 13 and the proximity to the ground plane at the time of the burster charge detonation which forms the cloud.

After the dynamic FAE cloud is formed, it must be detontated by causing one or more explosions to take place within the boundaries of cloud. This explosion is called the second event (SE) as distinguished from the burster charge which originally caused the FAE cloud to be formed. The specific requirements of the second event explosion are determined by the size, delay and spatial position of the FAE cloud. In the view of FIG. 1, a second event package in the form of a grenade launcher 15 is attached to the rearward end portion of the bomb 13. The launcher 15 effectively deploys one or more grenades into the FAE cloud within the proper time frame causing the cloud to explode. Since the launcher 15 operates to accelerate the grenades rearwardly, the launch speed should normally equal the flight velocity of the bomb 13 in the opposite direction so that the net velocity is approximately zero. This retrolaunching process must be accomplished during the time that the FAE bomb is bursting and causing the fuel-air mixture to be formed and reach explosive conditions. Thus, it can be seen that time element as well as the positioning of the grenades in the FAE cloud is extremely critical and varies wth the flight velocity and incident angles of the FAE bomb.

Figure 2:
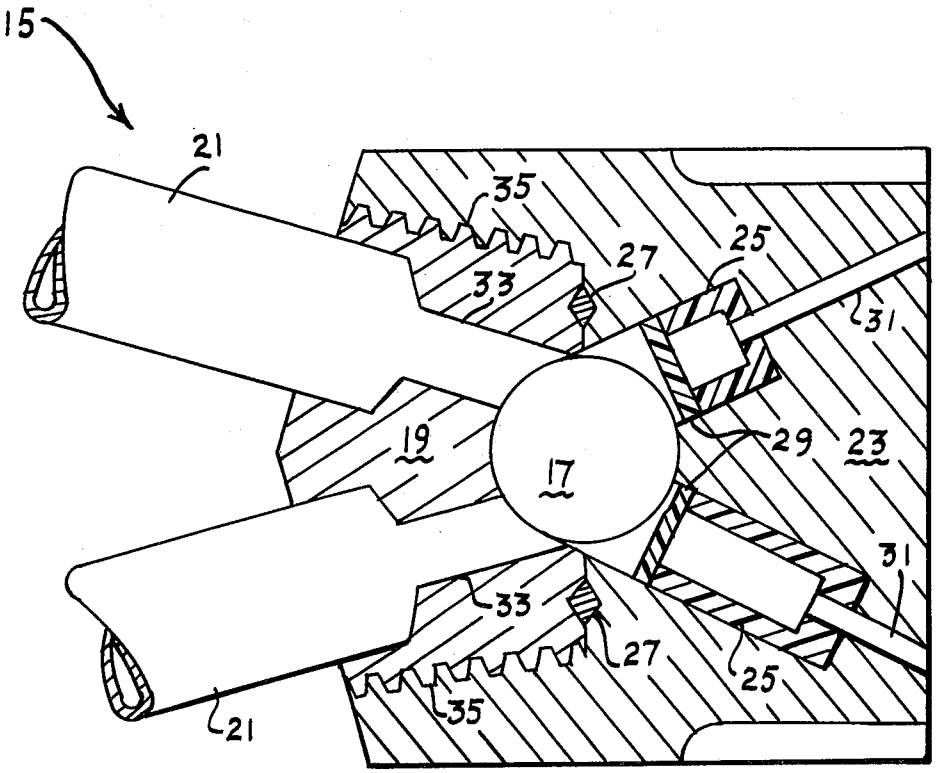
FIG. 2 is a side view in partial cross-section of a retrolauncher according to the invention showing two of the four barrels and charges with the single chamber detonation system.

In FIG. 2, there is shown the retrolauncher 15 according to the invention in partial cross-section including a spherical chamber 17 formed when the two piece housing is screwed together. In one portion of the housing 19 there are positioned a plurality of gun tubes 21 located in a circular pattern about the axis and angularly oriented to direct grenades (not shown) normally disposed therein in a scattering pattern. In the other portion of the housing 23 there are positioned a plurality of explosive charge holders 25 of varying sizes which are also positioned in a circular pattern about the axis. Both the gun tubes 21 and the charge holders 25 are in operative communication with the spherical chamber 17. An annular gas seal 27 which is of diamond shaped cross-section is positioned in suitable grooves in adjacent faces of two housing portions 19 and 23 and serves to provide a seal to prevent the leakage of gas from the chamber 17.

Each explosive charge holder 25 is provided with a corresponding cap 29 to retain the explosive charge therein. The holders 25 and caps 29 are preferably fabricated of a material such as Teflon to prevent sympathetic detonation of adjacent charges. An electric detonator housing 31 is pressed into each of the charge holders 25 so that each explosive charge can be separately detonated.

The central chamber 17 is vented to each of the gun tubes 21 through a corresponding choke 33 which operates to carry the gas to the gun tubes 21. The chokes 33 are designed to leave sufficient center web section between the gas ports to stop the charge caps 29 from entering the gun tubes 21 during firing. A modified Hughes Oil Tool Acme thread 35 permits quick and easy assembly of the launcher 15 and provides a system whereby the portions 19 and 23 can be disassembled after firing, if necesary.

MODE OF OPERATION

In operation, the high explosive launcher system 15 is attached to the rear of the bomb 13 and fits within the bomb fairing as shown in the exploded view of FIG. 1. The launcher system 15 which has no moving parts includes a plurality of gun tubes 21 which are oriented at an angle from the axis of the bomb 13 so that the trajectory of the grenades can be adjusted to the optimum angle. When the FAE bomb 13 with the launcher system 15 attached reaches the target area, a burster charge explodes (first event) causing fuel to be scattered about and create an FAE cloud. At a given signal the launcher system 15 is activated and one or more of the explosive charges 25 explodes causing grenades (not shown) in the gun tubes 21 to be ejected and deployed into the FAE cloud where they explode. This causes the FAE cloud to detonate (second event) thereby producing the desired result in the target area.

A typical FAE cloud may have an outer diameter of 60 feet and its thickness may be about 20 feet to form a distorted torus configuration. This form will be reached about 100 milliseconds after the burster charge is detonated. The second event system delivers a charge to an appropriate position within the cloud so that, when the second event charge detonates the FAE cloud will also detonate. The high explosive launcher 15 includes four different size charge holders 25 each with a different size charge for selectively controlling the launch speed of the grenades. Charges of 3, 6, 12, and 24 grams can be selectively combined to produce a 250 to 900 feet per second launch speed range in 40 to 70 feet per second increments. The combination of launch charges can be selected by any of several suitable means such as by a solid state logic system with a four bit binary output, with output a function of some type of input signal proportional to the bomb speed. Suitable speed detectors include systems which convert dynamic air pressure to a proportional signal, such as one which relies on fluidics to generate an AC signal proportional to speed and one wherein the position of a linear potentionmeter is controlled by dynamic air pressure balance with a calibrated spring. Also, a speed detector based on Doppler radar rather than on dynamic air pressure and therefore not subject to errors because of variations in air density at different altitudes and temperatures can be used.

Thus it can be seen that a high explosive launcher system has been described which solves the critical second event of an FAE bomb detonation by effectively detonating the gas cloud in the very short time required. The FAE four-barrel, four-charge, single chamber detonation system solves the high speed delivery problem by providing a cloud detonator concept that functions over a wide range of impact velocities thereby allowing a wider range of delivery conditions and accuracy of the FAE system.

Although the invention has been described in the foregoing specification and illustrated in the accompanying drawings in terms of a preferred embodiment thereof, the invention is not limited to this embodiment or to the preferred configuration mentioned. It will be apparent to those skilled in the art that my invention could have extensive use in other operations where it is desirable to propel a plurality of missiles at a controlled velocity in a predetermined scatter pattern.

Having thus set forth the nature of my invention, what I claim and desire to secure by Letters Patent of the United States is:

1. A high explosive launcher system for detonating the cloud from a fuel-air-explosive bomb having a retrolauncher positioned on the rearward portion thereof, said retrolauncher comprising a housing having two joined portions disposed along the central axis thereof, a plurality of gun tubes each containing at least one grenade positioned in one portion of said housing, said gun tubes being disposed in a circular pattern angularly oriented with respect to the central axis of said retrolauncher housing to direct therein in an angularly outward direction away from the central axis, a plurality of explosive charges disposed in a corresponding plurality of explosive charge holders positioned in the other portion of said housing, each of said explosive charges being disposed in a circular pattern around the axis and progressively varying in size, a cap positioned on each of said charge holders to protect the charge therein from sympathetic detonation, a chamber in operative communication with all of said gun tubes and said explosive charges, one part of said chamber being in one portion of said housing and the other part of said chamber being in the other portion of said housing, means for maintaining the two portions of said housing in close gas-tight relationship and means for selectively firing the explosive charges to produce the desired pressure in said chamber thereby providing the proper launch velocity for the grenades leaving the retrolauncher.

2. The high explosive launcher system having the retrolauncher positioned thereon defined in claim 1 wherein the chamber in operative communication with said gun tubes and said explosive charges is spherical in configuration, each portion of said housing including a hemispherical portion of said chamber.

3. The high explosive launcher system having the retrolauncher positioned thereon defined in claim 2 wherein the explosive charge holders positioned in the other portion of said housing and the caps positioned on each of said charge holders are fabricated of tetrafluoroethylene resin.

4. The high explosive launcher system having the retrolauncher positioned thereon defined in claim 2 wherein an annular seal of diamond cross-sectional configuration is positioned in complementary V grooves in adjacent faces of each portion of said housing forming a gas-tight seal therebetween.

* * * * *